US007810663B2

(12) United States Patent
Young

(10) Patent No.: US 7,810,663 B2
(45) Date of Patent: Oct. 12, 2010

(54) TAMPER-EVIDENT CLOSURE

(76) Inventor: John Young, 12425 Honolulu Ter., Whittier, CA (US) 90601

( * ) Notice: Subject to any disclaimer, the term of this patent is extended or adjusted under 35 U.S.C. 154(b) by 576 days.

(21) Appl. No.: 11/786,291

(22) Filed: Apr. 10, 2007

(65) Prior Publication Data

US 2007/0235406 A1 Oct. 11, 2007

Related U.S. Application Data

(60) Provisional application No. 60/791,375, filed on Apr. 11, 2006.

(51) Int. Cl.
*B65D 41/00* (2006.01)

(52) U.S. Cl. ..... 215/253; 215/235; 220/254.3

(58) Field of Classification Search ..... 220/291, 220/833, 836, 839, DIG. 34, 263, 266; 215/237, 215/250, 251, 901, 253
See application file for complete search history.

(56) References Cited

U.S. PATENT DOCUMENTS 4,378,073 A * 3/1983 Luker ..... 215/237
5,662,245 A 9/1997 Grant
5,853,093 A * 12/1998 Neiger ..... 215/237
5,875,907 A 3/1999 Lay
6,347,716 B1 2/2002 Nofer et al.
6,398,067 B1 * 6/2002 Belfance et al. ..... 220/833
6,715,646 B2 4/2004 Suffa
6,848,603 B2 2/2005 Gaiser et al.
6,976,607 B2 12/2005 Benoit-Gonin et al.
2001/0032827 A1 10/2001 Montgomery et al.
2004/0069806 A1 * 4/2004 Benoit-Gonin et al. . 222/153.06
2004/0150221 A1 8/2004 Brown
2005/0173368 A1 * 8/2005 Nusbaum et al. ..... 215/237
2006/0011573 A1 1/2006 Herald et al.

* cited by examiner

*Primary Examiner*—Anthony Stashick
*Assistant Examiner*—Jeffrey Allen
(74) *Attorney, Agent, or Firm*—Kenneth L. Green

(57) ABSTRACT

A bottle cap includes a mouthpiece having a dispensing orifice, a collar which extends downward from the mouthpiece to engage the bottle, a cover connected to the collar by a hinge and movable between open position and closed position covering the orifice, and a tamper-evident strap connecting the closed cover to the collar. The strap is hingeably joined to the collar by a lower portion of the strap and connected to the cover by a barbed upper portion. The upper portion cooperates with the cover to retain the strap to prevent manipulation of the strap to open the cover without severing the strap. The strap has a severable mid point which severs when the cover is first opened. When the cover is opened, both portions of the strap remain attached to the bottle and the lower portion swings away from the collar providing visible evidence of prior opening.

13 Claims, 7 Drawing Sheets

TAMPER-EVIDENT CLOSURE

The present application claims the benefit of U.S. Provisional Application Ser. No. 60/791,375, filed Apr. 11, 2006, which application is incorporated herein by reference.

BACKGROUND OF THE INVENTION

The present invention relates to bottle closure devices and in particular to a bottle closure device with a tamper proof feature.

Plastic caps are commonly used for closing a container having a neck, for example, a bottle made of plastic material designed to contain water. It is known to use a plastic cap including an upper part having a dispensing orifice for dispensing the contents of the bottle. The cap also includes a substantially cylindrical collar extending downward from the upper part and having features on an inner face of fixing the cap onto the neck of the bottle. In order to be able to ensure closure of the dispensing orifice, the cap also includes a cover. The cover may be detachable or connected to the upper part by at least one hinge in order to be movable between an open position and a closed position over the dispensing orifice.

In order to ensure the integrity of the contents of the bottle before its first opening, known caps often include a tamper-evident strap generally situated opposite the hinge and connecting the collar and a capture feature in the cover. The tamper-evident straps are divided at a midpoint by one or more severable strips each having a zone of least resistance for tearing or breaking. The straps generally include a barb for engaging the capture feature in the cover in a manner which may not disengage without damage to the strap.

More often than not, such a cap is injection molded of plastic material which produces a one piece cap with an open cover (i.e., the cover is not closed over the dispensing orifice). Thus, before first use of the cap, the cover is placed in the closed position covering the dispensing orifice, with the barb of the tamper-evident strap engaging the capture feature in the cover. Such cap and cover arrangement enables the hermetic closure of a container to be ensured and generally guarantees the integrity of the contents of the container. Moreover, after the first opening of some known covers, the user must deal with a discardable portion separated from the tamper-evident strap, which is no longer of any use. The user does not always have such suitable disposal means available.

Other tamper evidence devices provide means for retaining the severed portion of the tamper evidence device to eliminate the trash but provide no clear indication of prior opening. Devices which retain the severed portions of the tamper evidence device typically rely on the noise and feel generated when the severable connectors rupture to notify the user of the integrity of the tamper evidence device, but provide no obvious indications of rupture after opening, thus creating a situation in which the user could purchase or consume beverage from a container unaware of a prior opening.

Many variations of tamper evidence devices exist, each typically generating a different feel and sound when ruptured. Additionally, slight variations in each type of tamper evidence device due to manufacturing inconsistencies can result in a slightly different feel and sound when opened for the first time. It is therefore possible for a consumer to open an unfamiliar cap for the first time and not be confident of the container's contents integrity, defeating the purpose of the tamper evidence device.

There is thus a need for a cap whose tamper-proof system, comprising of the tamper-evident strap and the capture feature in which the strap is engaged, can guarantee the integrity of the contents of the container more effectively than known caps by providing obvious evidence of prior opening. A further need exists for a tamper evidence device which may be fabricated without requiring complicated moving parts in the mold or without adding parts or assembly steps to the cap which increase the cost of the cap.

BRIEF SUMMARY OF THE INVENTION

The present invention addresses the above and other needs by providing a bottle cap which includes a mouthpiece having a dispensing orifice, a collar which extends downward from the mouthpiece to engage the bottle, a cover connected to the collar by a hinge, the cover movable between open position and closed position covering the orifice, and a tamper-evident strap connecting the closed cover to the collar. The strap is hingeably joined to the collar at a lower end of a lower portion of the strap and connected to the cap by a notched or barbed upper portion. The strap has a tearable or breakable mid point which severs when the cover is first opened. The upper portion cooperates with the cover to retain the strap in order to prevent manipulation of the strap to open the cover without severing the strap. When the cover is opened, the severed upper portion of the strap remains attached to the cover and the hingeably attached lower portion of the strap swings away from the cap collar providing visible evidence of prior opening.

In accordance with one aspect of the invention, there is provided a cap for closing the neck of a container. The cap includes a mouthpiece having a dispensing orifice for dispensing the contents of the container, a collar below the mouthpiece and having means for fixing the cap onto the neck of the container, a cover connected to the collar by at least one hinge in order to be movable between open and closed positions over the dispensing orifice, and a tamper-evident strap having a lower end which is hingeably joined to the collar and an upper end which engages a capture feature in the cover to retain the cover in the closed position. The tamper-evident strap is divided proximal to a midpoint by one or more severable strips each having a zone of least resistance for severing and includes a barbed or notched upper portion for engaging a capture mouth in the cover. When severed, the upper portion of the strap remains attached to the cover and the lower portion hinges away from the cap indicating that the cap has been opened at least once.

In accordance with another aspect of the invention, there is provided a method for manufacturing a bottle cap having a tamper-evident strap.

According to the invention, the cover includes means for retaining the tamper-evident strap in order to fixably attach the strap to the cover in the closed position of the cover and to prevent manipulation of the strap to open the cover without severance of the strap.

According to a characteristic of the invention, the strap retaining means are adapted to receive the upper portion of the strap in order to hold the severed upper portion on the cover after severance of the strap following a first opening of the cap. The strap retaining means therefore serves a dual purpose. First, to prevent manipulation of the strap aimed at defeating the tamper-evidence. Second, to retain the severed upper portion of the strap on the cover after opening.

According to another characteristic of the invention, the strap retaining means comprise at least one mouth in the cover for receiving the barbed or notched upper portion of the tamper-evident strap and to retain the upper portion of the tamper-evident strap on the cover after severing of the strips following a first opening of the cap.

According to another characteristic of the invention, the strap retaining means comprises at least one mouth for receiving the strap, the mouth having one or more hooking edges which fit a ledge of the tamper-evident strap.

According to another characteristic of the invention, the tamper-evident strap has a notch residing level with the hooking edge of the mouth when the cover is in the closed position.

Various other characteristics of the invention are described below with reference to the attached drawings, which show non-limiting embodiments of a cap according to the present invention.

BRIEF DESCRIPTION OF THE SEVERAL VIEWS OF THE DRAWING

The above and other aspects, features and advantages of the present invention will be more apparent from the following more particular description thereof, presented in conjunction with the following drawings wherein.

Corresponding reference characters indicate corresponding components throughout the several views of the drawings.

DETAILED DESCRIPTION OF THE INVENTION

The following description is of the best mode presently contemplated for carrying out the invention. This description is not to be taken in a limiting sense, but is made merely for the purpose of describing one or more preferred embodiments of the invention. The scope of the invention should be determined with reference to the claims.

Figure 1:
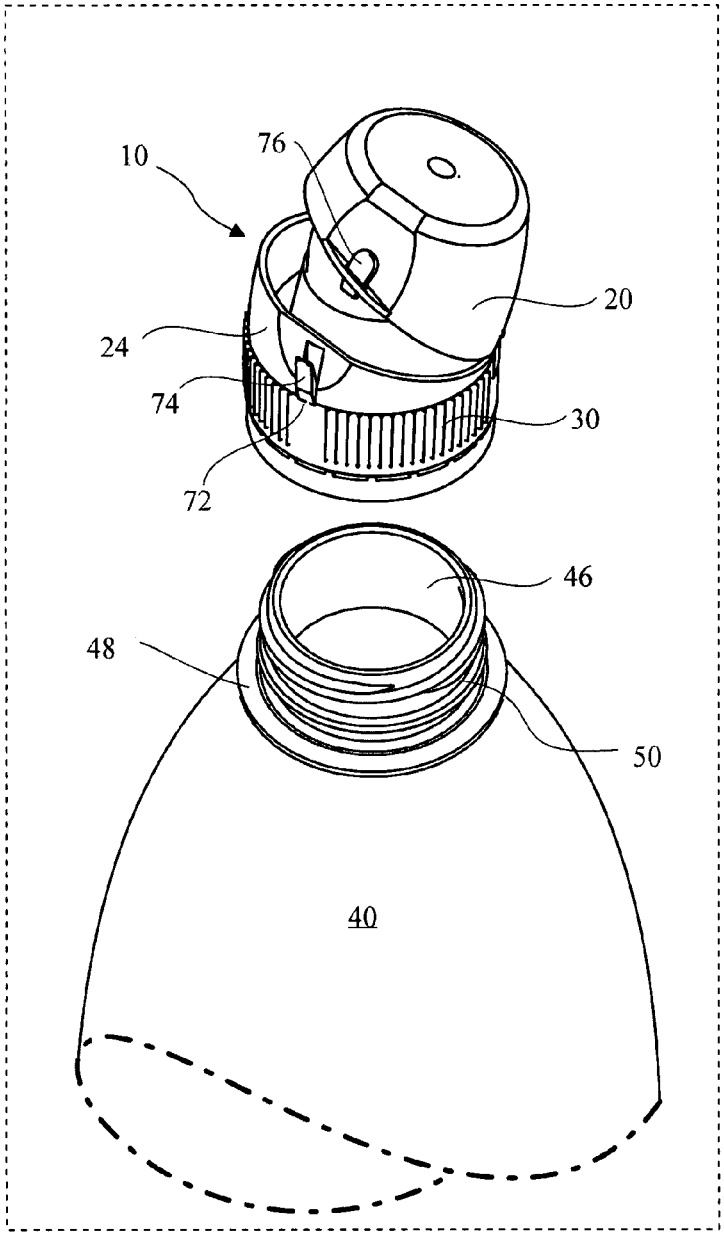
FIG. 1 is a perspective top view of a cap according to the present invention and a beverage container after first opening and rupture of a tamper-evident strap connecting a cap cover to a cap collar.
Figure 2:
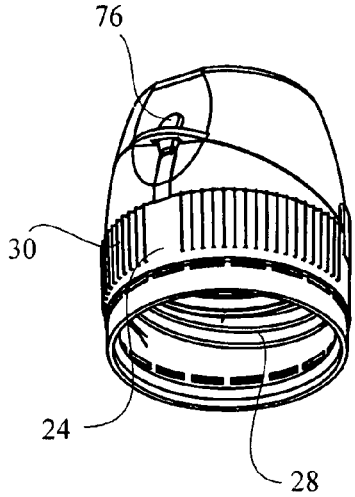
FIG. 2 is a perspective bottom view of the cap with the cover in the fully closed position.

A cap 10 according to the present invention and a top portion of a beverage container 40 suitable for use with the cap 10 are shown in FIG. 1 and a perspective bottom view of the cap 10 with the cover 20 in the fully closed position is shown in FIG. 2. The container 40 which may be any container for containing a fluid, such as a plastic bottle for a single serving of a liquid sport drink or water. The container 40 forms a closed vessel having side walls, a bottom wall, and a top section having an upright annular neck 46 which is hollow and serves as the sole opening for the passage of fluid out of the container.

The cap 10 is molded as one piece and includes a top cover 20 which is movably connected by a first hinge 22 (see FIG. 3) to a base collar 24 adapted to mate with the container 40. The hinge 22 allows the cover 20 to be movable between an open position for dispensing liquid and a closed position for protecting contents of the container 40. The collar 24 includes interior threads 28 for mating engagement with the beverage container 40. An exterior annual wall of the collar 24 includes a multiplicity of vertical ribs or splines 30 which are engagable by standard packaging machinery to provide gripping surfaces to assist in threading the interior threads 28 onto the beverage container 40 after the container has been filled during the manufacturing process. The external ribs 30 also assist a user in attaching or detaching the cap 10 from the beverage container 40 for reuse. The upright annular neck 46 includes an annular rib 48 at a base of the neck 46, and external threads 50 are located above the rib 48 for mating engagement with the internal threads 28 of the base collar 24.

Figure 3:
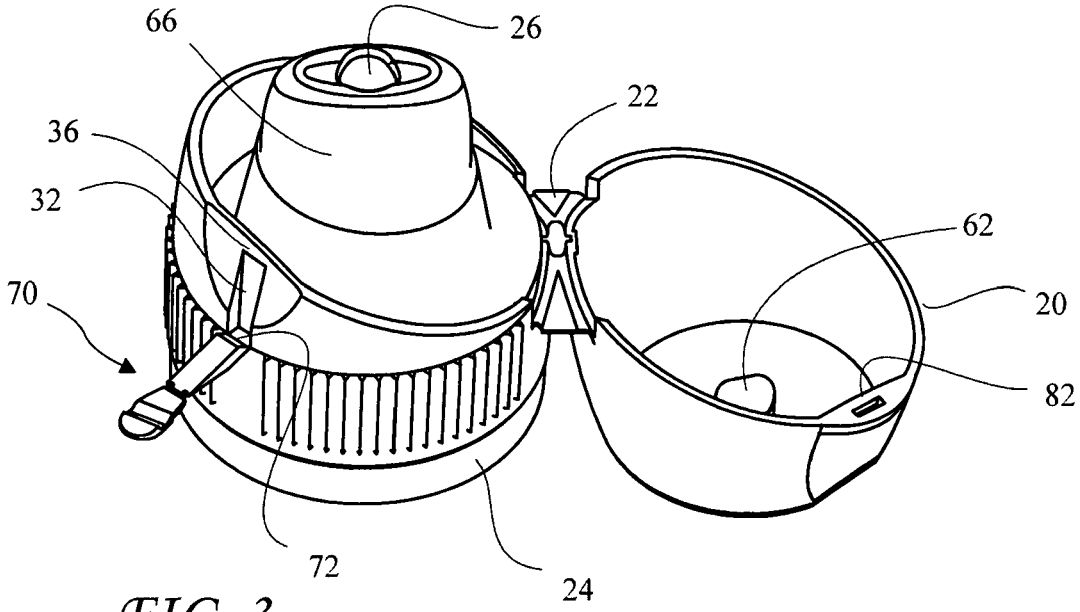
FIG. 3 is a perspective top view of the cap with the cover in the fully open position, such as the cap appears upon leaving the mold.
Figure 4:
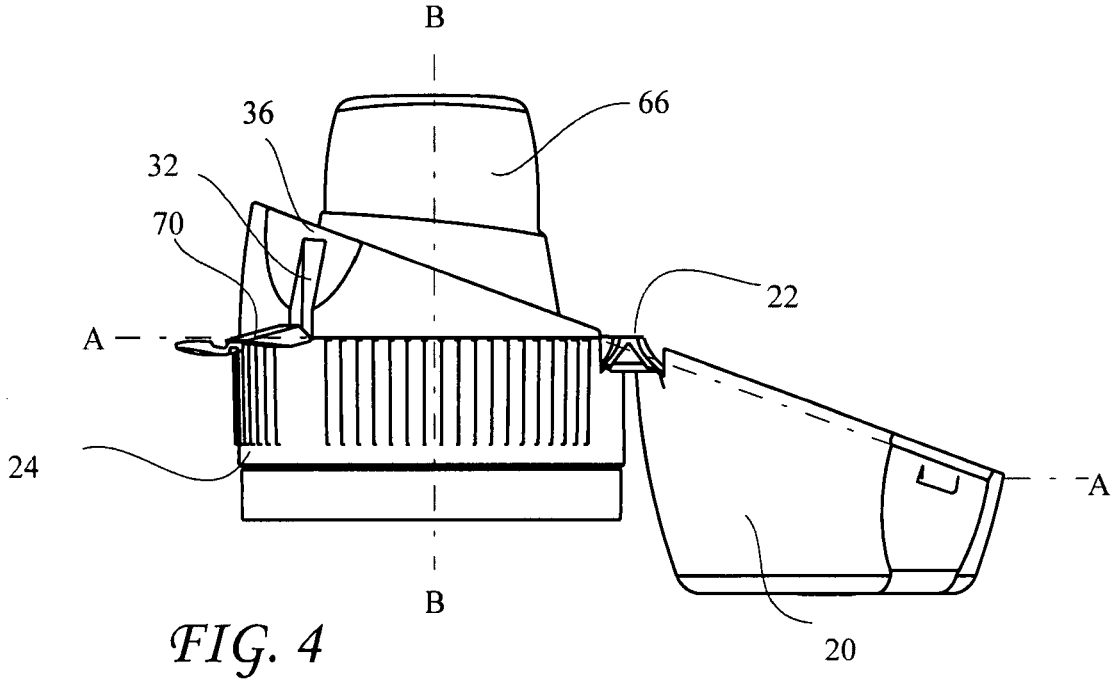
FIG. 4 is a side view of the cap with the cover in the fully open position, such as the cap appears upon leaving the mold.

The cap 10 is preferably made of plastic material by molding and is preferably molded in the open configuration (i.e., the cover 20 opposite the base 24) illustrated in FIGS. 3, 4. More preferably, the cover 20 and base collar 24 are injection molded as a single piece connected by the hinge 22 (see FIGS. 3, 4), and more preferably, the cover 20 and base collar 24 are formed of a polyethylene (PE) or polypropylene (PPL), but any suitable material may be used.

A perspective top view of the cap 10 with the cover 20 in a fully open position, such as a cap obtained on leaving the mold, is shown in FIG. 3, and a side view of the cap 10 with the cover 20 in the fully open position, such as a cap obtained on leaving the mold, is shown in FIG. 4. The liquid dispensing orifice 26 is located on a flattened peak of an upright mouthpiece 66. The mouthpiece 66 extends upwardly to the peak, and forms the dispensing orifice 26 at the center of the peak. After removal from the mold and before use of the cap, the cover 20 is placed in a closed position over the orifice 26 (see FIGS. 2 and 9) wherein an upper portion 76 of a tamper-evident strap 70 is engaged with a capture feature comprising a capture mouth 82 of the cover 20.

The tamper-evident strap 70 is attached by a hinge portion 72 to the collar 24. The tamper-evident strap 70 is attached to the collar 24 on a side of the collar 24 opposite the hinge 22 and extending approximately horizontally away from the collar 24 along the parting plane of the mold as shown by line A-A in FIG. 4. As seen in FIGS. 3 and 4, the tamper-evident strap 70 is preferably molded with the length of the tamper-evident strap 70 approximately perpendicular to the vertical axis of the cap as defined by line B-B in FIG. 4. Molding the tamper-evident strap 70 in such manner provides a bias to a lower portion 74 (see FIG. 5) of the of the tamper-evident strap 70, which bias of the lower portion 74 provides an indicator that the cap 10 has been opened after severance of the tamper-evident strap 70.

Figure 5:
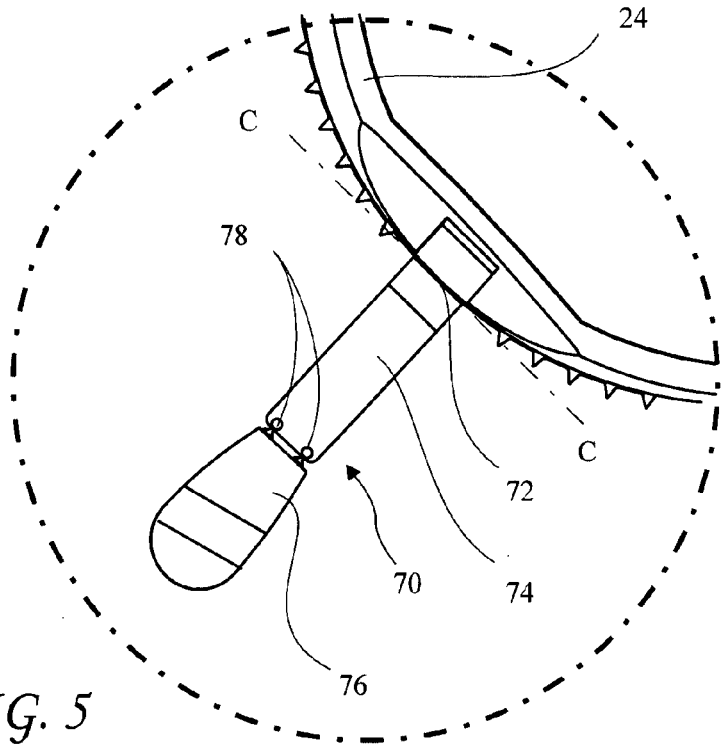
FIG. 5 is a partial top detail view of the cap with the strap extending horizontally, such as obtained on leaving the mold.

A partial top view detail of the cap 10 with the tamper-evident strap 70 extending approximately horizontally such as the cap 10 obtained on leaving the mold, is shown in FIG. 5. The tamper-evident strap 70 comprises a lower portion 74, an upper portion 76, a severable portion comprising two horizontally spaced apart severable strips 78, and the hinge portion 72 having an axis defined by line C-C. The severable strips 78 are approximately vertically centered on the tamper-evident strap 70 when the tamper-evident strap 70 resides vertically and allow the upper portion 76 to be severed from the lower portion 74 when the cover 20 is first opened. The hinge portion 72 allows the tamper-evident strap 70 to be pushed to a vertical position to engage the cover 20, and retains a memory to bias the lower portion 74 back towards the approximately horizontal position upon severance of the severable strips 78 as an indicator that the cap 10 has been opened. While a preferred embodiment of the present invention includes the tamper-evident strap 70 molded in an approximately horizontal position, any cap with a tamper-evident strap molded sufficiently away from vertical to provide an indication that the cap has been opened is intended to come within the scope of the present invention.

Figure 5A:
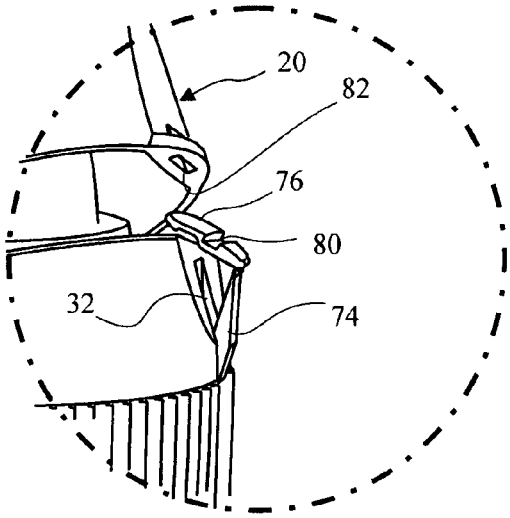
FIG. 5A is a side view of the tamper-evident strap distorted as might occur after molding such that the severable upper portion is inclined toward the cap centerline.
Figure 5B:
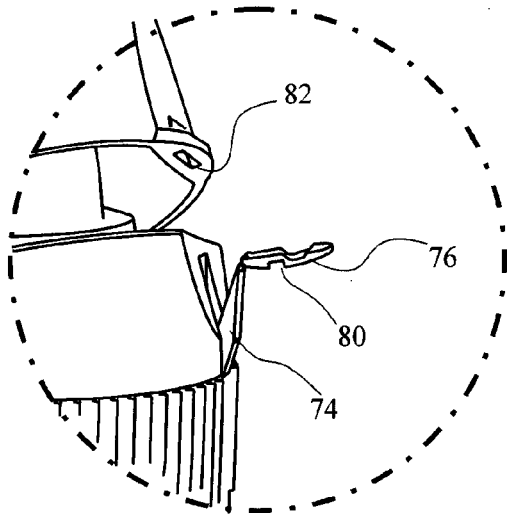
FIG. 5B is a side view of the tamper-evident strap distorted as might occur after molding such that the severable upper portion is inclined away from the cap centerline.

While the tamper-evident strap 70 generally assumes an approximately horizontal position after molding, in some instances, there may be some distortion of the tamper-evident strap 70. A side view of the tamper-evident strap 70 distorted as might occur after molding such that the severable upper portion 76 is inclined toward the cap centerline B-B is shown in FIG. 5A, and a side view of the tamper-evident strap 70 distorted as might occur after molding, such that the severable upper portion 76 is inclined away from the cap centerline B-B, is shown in FIG. 5B. To assemble the cap 10, the tamper-evident strap 70 must be rotated about the hinge portion 72, so the length of the tamper-evident strap 70 is approximately parallel to the axis B-B of the cap (see FIGS. 2, 7, and 8) to align the upper portion 76 to engage the capture mouth 82 of the cap 20. Molding the tamper-evident strap 70 approximately perpendicular to the central axis B-B of the cap (see FIG. 4) and rotating the tamper-evident strap 70 to a position approximately parallel to the central axis B-B of the cap 20 allows a hook slot 80 of the tamper-evident strap 70 and severable strips 78 of the tamper-evident strap 70 to be formed without creating an undercut in the mold which would add complexity and expense. The molding described herein provides a cap which is thus easily manufactured. Additionally, molding a tamper-evident strap 70 perpendicular to the central axis B-B of the cap biases the lower portion 74 of the tamper-evident strap 70 to swing away from collar 24 when the tamper-evident strap 70 severed, clearly indicating prior opening.

It is standard manufacturing practice to eject the caps from the mold immediately after molding, while the caps are still hot and relatively soft. Although it is preferred to mold the cap 10 with the tamper-evident strap 70 perpendicular to the vertical axis of the cap as defined by line B-B, the newly molded caps generally free fall into a collecting hopper where the severable upper portion 76 of tamper-evident strap 70 can easily become misaligned often resulting in an unusable cap as shown in FIGS. 5A and 5B. In the case of the cap 10 of the present invention, the lower portion 74 is connected to the upper portion 76 by one or more strips 78 and is shown with two strips 78 which prevent the upper hook part 76 of the strap from bending laterally after molding. However, the strips 78 may undesirably allow the upper portion 76 of the tamper-evident strap 70 to bend inward as shown in FIG. 5A or bend outward as shown in FIG. 5B which would prevent the upper portion 76 from aligning with the engagement mouth 82 in the cover 20. It is therefore desirable to provide an alignment means such as recessed area 32 which assists in aligning the tamper-evident strap 70 to assure that upper portion 76 is aligned with the engagement mouth 82 of cover 20 when the cover 20 is closed for the first time.

Methods are known to those skilled in the art which will straighten the possible misalignments, but these known methods add extra procedures to the manufacturing process which reduces the speed and increase the cost of producing parts. It is common for some beverage closure manufacturers to require production rates of 1000 parts per minute to be processed. It is therefore desirable that the tamper-evident strap 70 is in the proper orientation without automation complexity and preferably that the misalignments of the tamper-evident strap 70 shown in FIGS. 5A and 5B be corrected during the process of rotating the tamper-evident strap 70 from the molded position and thereby causing the upper portion 76 of the tamper-evident strap 70 to properly align with mouth 82 to allow initial closure of the cover 20.

Figure 6A:
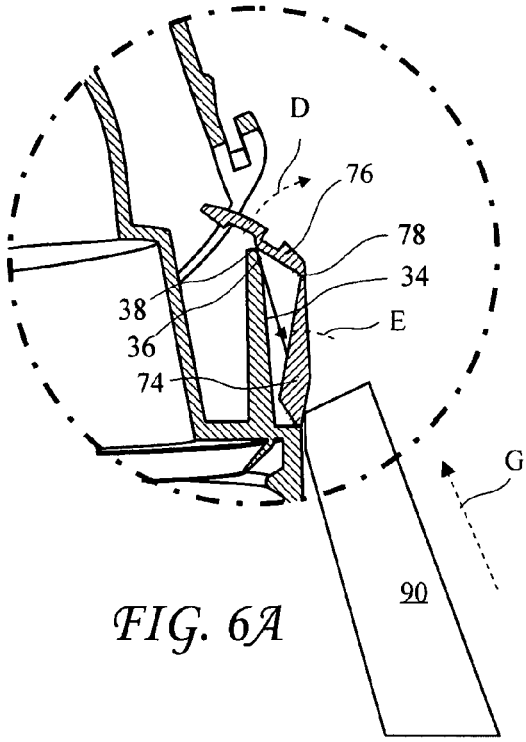
FIG. 6A is a side section view showing an assembly tool aligning the tamper-evident strap which is distorted after molding such that the severable upper portion is inclined toward the cap centerline.
Figure 6B:
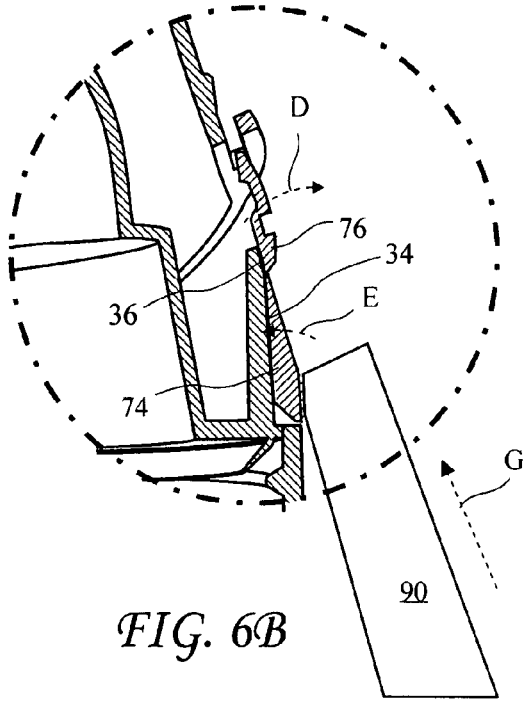
FIG. 6B is a side section view showing the aligned tamper-evident strap.

The operation of an automated tool 90 for aligning the tamper-evident strap 70 is shown in FIGS. 6A-6D. The tool 90 travels approximately parallel to the vertical axis of the cap 10, in the direction indicated by arrow G, and corrects misalignments of the tamper-evident strap 70 as it advanced along the tamper-evident strap 70. The realignment of the tamper-evident strap 70 when the upper portion 76 is folded inward is shown in FIGS. 6A and 6B. As the tool 90 advances along the lower portion 74, the lower portion 74 rotates counter-clockwise in the direction of arc E towards a wall 34 of the recess 32. The counter-clockwise rotation of the lower portion 74, and an upper edge 38 of an upper wall 36 (also shown in FIGS. 3, 4) above the wall 34, cause the upper portion 76 to rotate clockwise around the severable portion 78 in the direction of an arc D because the severable portion 78 is below the upper edge 38 of the upper wall 36. As the lower portion 74 comes to rest against the wall 34, the upper portion 76 also comes to rest against the upper wall 36 and into alignment with the engagement mouth 82 of the cover 20. Preferably, the severable portion 78 comes to rest at the meeting of the wall 34 and the upper wall 36 when the upper portion 76 comes into alignment with the engagement mouth 82.

Figure 6C:
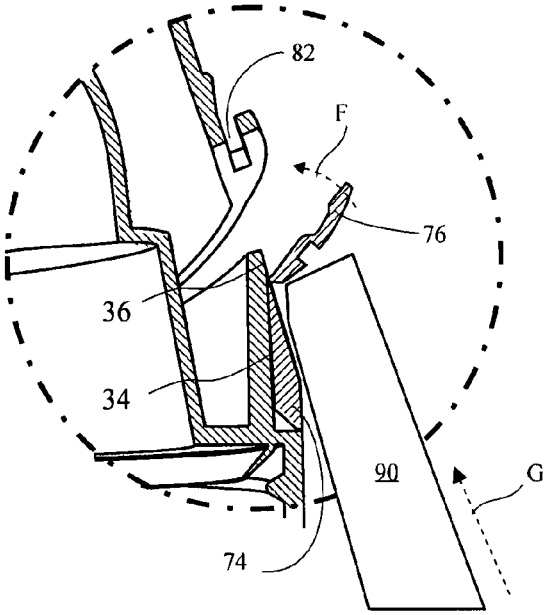
FIG. 6C is a side section view showing the assembly tool aligning the tamper-evident strap which is distorted after molding such that the severable upper portion is inclined away from the cap centerline.
Figure 6D:
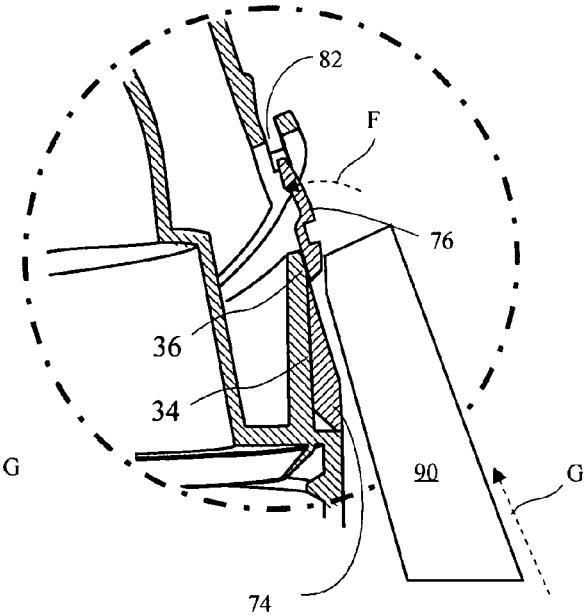
FIG. 6D is a side section view showing the aligned tamper-evident strap.

The realignment of the tamper-evident strap 70 when the upper portion 76 is folded outward is shown in FIGS. 6C and 6D. The tool 90 rides over the lower portion 74 pushing the lower portion 74 against the wall 34. When the tool 90 passed the severable portion 78, the tool 90 contacts the upper portion 76, and because the upper wall 36 is above the severable portion 78, the tool 90 pushed the upper portion 76 in a counter-clockwise direction along arc F against the upper wall 36 and into alignment with the engagement mouth 82 of the cap 20. It is thus seen that the placement of the upper wall 36 above the severable portion 78 provides for the simple alignment of the tamper-evident strap 70 whether the upper portion 76 is folded inward or folded outward, which provides a substantial manufacturing advantage to the present invention.

Figure 7:
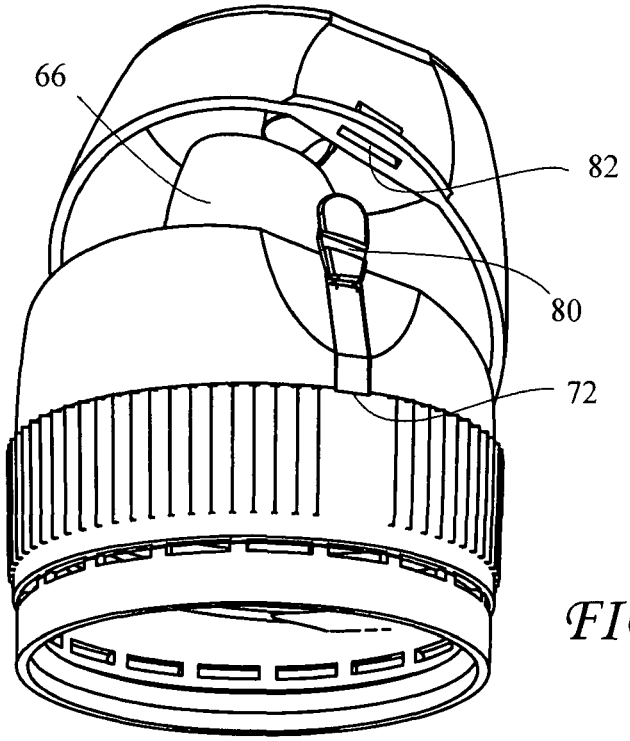
FIG. 7 is a perspective view showing the cap in the semi-open position of the cover before engaging the tamper-evident strap with the cover.
Figure 8:
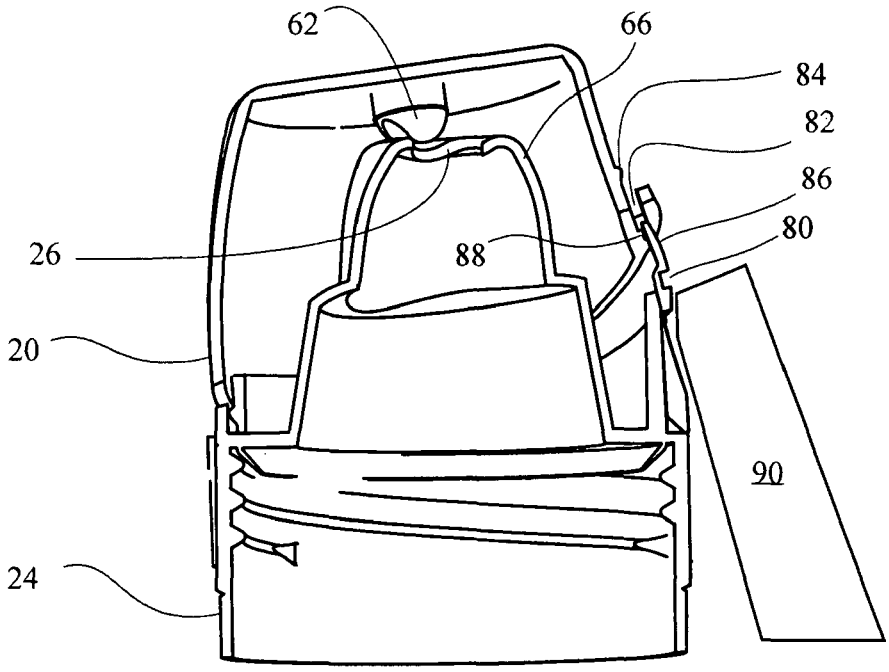
FIG. 8 is a side view cross section showing the cap in a partially open position and showing the assembly tool supporting the tamper-evident strap which is aligned for engagement with the cover.

The fully extended tamper-evident strap 70 is shown aligned with mouth 82 in FIG. 7, and the tamper-evident strap 70 is shown entering the mouth in FIG. 8. In addition to correcting miss-alignments of the tamper-evident strap 70, the tool 90 also provides support to the upper portion 76 while the tamper-evident strap 70 is entering the mouth 82, allowing the cover 20 to distort the upper portion 76 and mouth 82 to snap into place as shown in FIG. 9.

In other embodiments the tool 90 may have another form such as a wedge shape moving perpendicular to the axis of the cap 10 so as to increase in height in the direction of arrow G, without departing from the spirit and scope of the present invention.

The cap 10 is preferably made of plastic material by injection molding in the open configuration illustrated in FIG. 3 using methods common and known in the art. After removal from the mold and before use of the cap 10, the cover is placed in closed position of the orifice 26 such as illustrated in FIGS. 2 and 9 in which the upper portion 76 of the tamper-evident strap 70 is engaged with mouth of the cover 20.

Figure 9:
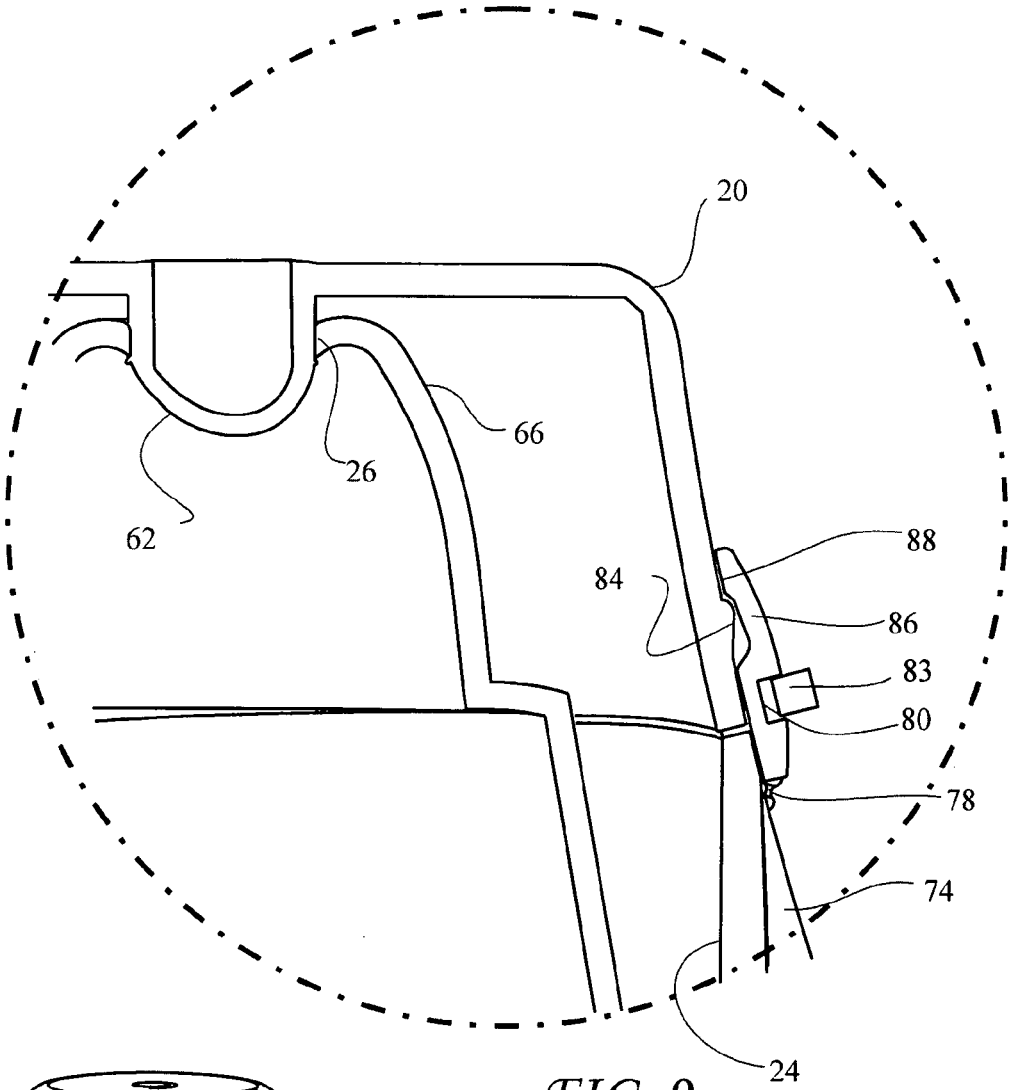
FIG. 9 is a partial side section view showing the cover fully closed and the tamper-evident strap engaged in the cover.

As seen in FIGS. 8 and 9, at the time of first closure, an engaging feature comprising a lateral slot 80 of the upper portion 76 non-disengageably engages mouth 82 in cover 20. In order to facilitate this engagement, a preferred upper portion 76 of the tamper-evident strap 70 preferably includes a tapered upper end 86 which guides and deflects sufficiently to allow the slot 80 in the upper portion 76 to be positioned such that it enters the engagement mouth 82 of the cover 20 and a lip 83 of the mouth 82 snaps into the slot 80 fixably locking the upper portion 76 into the engagement mouth 82 as seen in FIG. 9. Other retaining means may be utilized, and a cap with other retaining means for preventing easy release of the upper portion 76 from the mouth 82 are intended to come within the scope of the present invention.

Referring again to FIG. 9, it can be seen that cover 20 may include a raised section 84 which cooperates with the upper end 86 of the upper portion 76 by occupying a recess formed between the cover 20 and upper end 86 thereby preventing the upper end 86 from being deformed against the cover 20 so as to disengage the hook slot 80 from the engagement mouth 82. Further, it can be seen that a stop 88 impacts a raised section 84 so as to provide additional resistance to separation of the upper end 86 from the cover 20. As a result, further prying the upper end 86 away from cover 20 will not disengage hook slot 80 from engagement mouth 82.

After complete closure of the cover 20, the tamper-evident strap 70 is, on one hand, connected to the base collar 24 by the hinge portion 72 and, on the other hand, immobilized in the slot 80 in such a way that it is not possible to pull the tamper-evident strap 70 free in order to try to open the cover 20 without severing of the tamper-evident strap 70. The cap 10 therefore restricts the ability to manipulate the tamper-evident strap 70 by preventing the ability to deflect the tamper-evident strap 70 to disengage the slot 80 from the mouth 82, which cannot be disengaged without exerting sufficient force to sever the tamper-evident strap 70. With the cover 20 thus retained in a closed position by the tamper-evident strap 70, a user of the fluid container 40 may be confident that the container 40 has not been previously opened.

Figure 10:
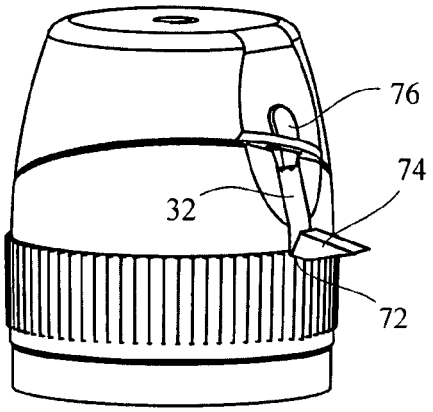
FIG. 10 is a side view of the cap of this invention with the cover in the closed position and the ruptured tamper-evident strap showing evidence of prior opening.

The tamper-evident strap 70 thus provides obvious evidence of a first opening of the cover 20. Moreover, after a first opening of cover 20 by severing of the severable strips 78, the upper portion 76 remains attached to the cover 20 as shown in FIGS. 1 and 10 and upper portion 76 remains fixably attached to the cover 20. In this way, the severable upper portion 76 of tamper-evident strap 70 remains attached to the cover 20, so that proper disposal of the upper portion is no longer required, thereby reducing littering. Additionally, as seen in FIG. 10, the lower portion 74 of the tamper-evident strap 70 is connected to the base collar 24 by a hinge portion 72, wherein the hinge portion 72 provides a bias towards the horizontal to the lower portion 74, and the lower portion 74 thereby swings out of recess 32 providing visible evidence of prior opening of the cover 20 when the strips 78 are severed.

As shown in FIGS. 8 and 9, the cover 20 includes a central stopper plug 62 which inserts snugly into and blocks the orifice 26 when the cover is rotated to a closed position. The cover 20 thus covers the dispensing orifice 26 and provides a positive stopper 62 for the fluid dispensing opening, assist in preventing tampering and intentional or accidental contamination of the liquid in the container prior to purchase and individual use by a consumer.

The present invention has been described above using terms horizontal and vertical. For the purposes of this description, the bottle 40 is assumed to reside vertically as in FIG. 1 with the cap 10 above the bottle 40, and vertical is assumed to refer to aligned with a centerline of the bottle 40, and horizontal to any plane perpendicular to the vertical.

Figure 11:
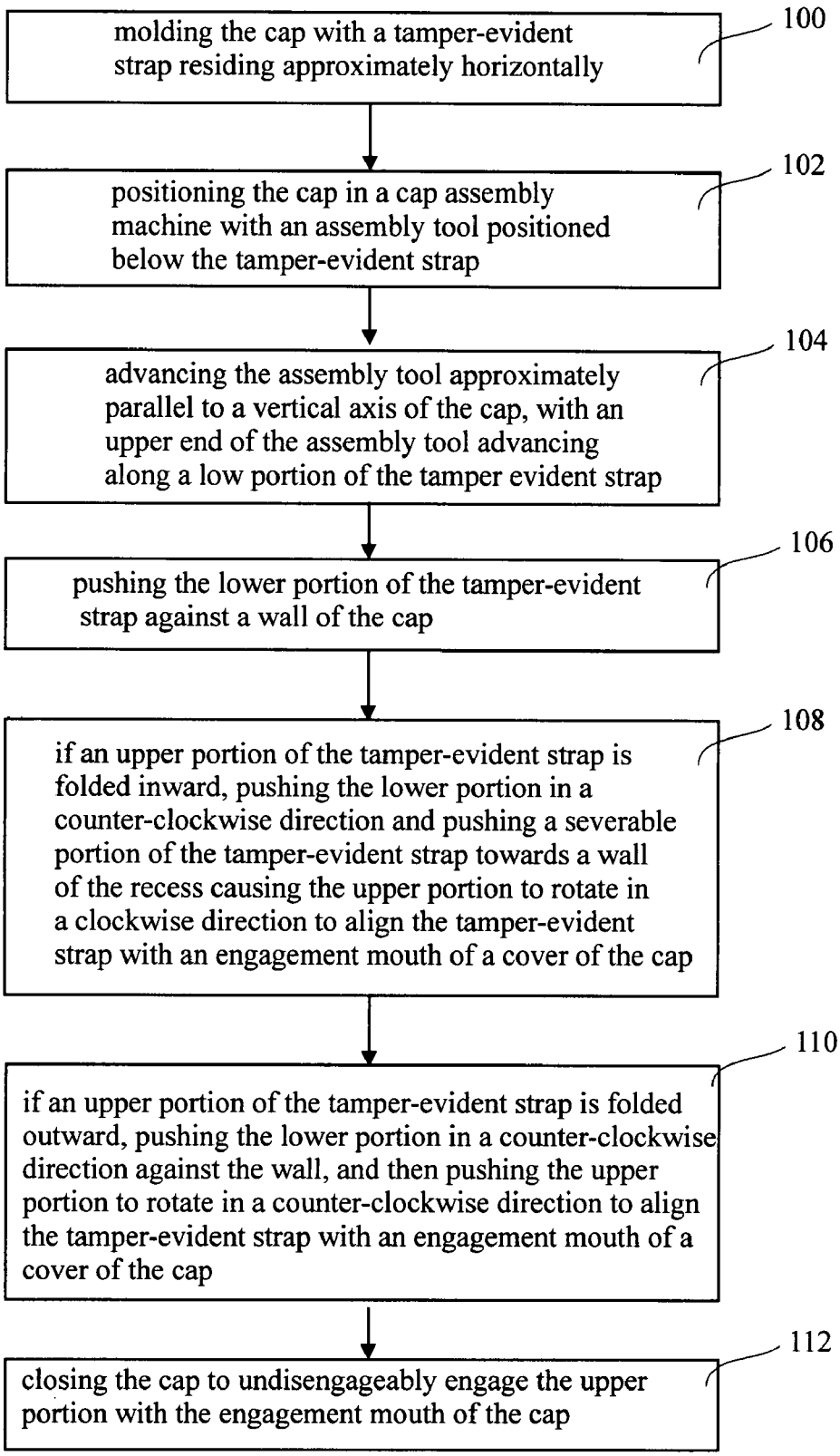
FIG. 11 is a method for manufacturing a bottle cap according to the present invention.

A method for manufacturing the cap 10 is described in FIG. 11. The method includes the steps of: molding the cap with a tamper-evident strap residing approximately horizontally to provide a bias of the tamper-evident strap toward the horizontal at step 100; positioning the cap in a cap assembly machine with an assembly tool positioned below the tamper-evident strap at step 102; advancing the assembly tool approximately parallel to a vertical axis of the cap, with an upper end of the assembly tool advancing along a low portion of the tamper evident strap at step 104; pushing the lower portion of the tamper-evident strap against a wall of the cap at step 106; if an upper portion of the tamper-evident strap is folded inward, pushing the lower portion in a counter-clockwise direction and pushing a severable portion of the tamper-evident strap towards a wall of the recess causing the upper portion to rotate in a clockwise direction to align the tamper-evident strap with an engagement mouth of a cover of the cap at step 108; if an upper portion of the tamper-evident strap is folded outward, pushing the lower portion in a counter-clockwise direction against the wall, and then pushing the upper portion to rotate in a counter-clockwise direction to align the tamper-evident strap with an engagement mouth of a cover of the cap at step 110; and closing the cap to undisengageably engage the upper portion with the engagement mouth of the cap at step 112.

While the invention herein disclosed has been described by means of specific embodiments and applications thereof, numerous modifications and variations could be made thereto by those skilled in the art without departing from the scope of the invention set forth in the claims.

I claim:

1. A tamper-evident bottle cap comprising:

a collar having an attachment feature residing in a horizontal plane for attaching the cap to a bottle;

a mouthpiece connected to the collar for drinking liquid from the bottle;

a cover hingedly attached to the collar and having a closed position wherein the mouthpiece is covered and an open position wherein the mouthpiece is uncovered to allow drinking; and a tamper-evident strap having a lower portion hingedly attached to the collar, and an upper portion non-disengageably engagable with the cover when the cover is placed in the closed position and remaining non-disengageably engaged with the cover thereafter when the cover is placed in the open position, wherein the tamper-evident strap is severable to separate the upper portion from the lower portion when the cover is opened, and wherein the lower portion is biased towards the horizontal plane when detached from the upper portion and moves outward from the cap providing a visual indication that the cap has been opened, where:

the upper portion of the tamper-evident strap includes a lateral slot; and the cover includes an engagement mouth, the upper portion of the tamper-evident strap passing therethrough, the engagement mouth having a lip for engagement with the lateral slot.

2. The tamper-evident bottle cap of claim 1, wherein:

the tamper-evident strap and the collar are molded as a unit and the tamper-evident strap is hingedly connected to the collar by a hinge portion; and the lower portion of the tamper-evident strap is biased towards the horizontal plane by the hinged portion.

3. The tamper-evident bottle cap of claim 2, wherein the tamper-evident strap is molded in the horizontal plane of the cap thereby providing the horizontal bias to the lower portion of the tamper-evident strap and providing an economical method of manufacturing.

4. The tamper-evident bottle cap of claim 3, wherein the tamper-evident strap further includes at least two horizontally spaced apart severable strips connecting the upper portion to the lower portion.

5. The tamper-evident bottle cap of claim 4, wherein the at least two horizontally spaced apart severable strips reside approximately vertically centered on the tamper-evident strap when the tamper-evident strap resides vertically.

6. The tamper-evident bottle cap of claim 1, wherein:

the upper portion and the lower portion tamper-evident strap are connected by a severable strip prior to severing the upper portion from the lower portion;

before severing the severable strip, the lower portion of the tamper-evident strap resides against a wall, and the upper portion of the tamper-evident strap resides against an upper wall above the wall; and the severable strip of the tamper-evident strap resides between the wall and the upper wall on the closed cap.

7. The tamper-evident bottle cap of claim 6, wherein the upper portion is aligned with an engagement mouth of the cover when the upper portion is residing against the upper wall.

8. The tamper-evident bottle cap of claim 1, wherein the attachment feature comprises female threads inside the collar.

9. The tamper-evident bottle cap of claim 1, wherein:

the cover further includes a raised section above the engagement mouth;

an upper end of the upper portion of the tamper-evident includes a stop which reaches past and over the raised section of the cover when the tamper-evident strap fully engages the cover to resist separation of the upper end of the upper portion of the tamper-evident strap from the cover, and the combined cooperation of the lateral slot with the engagement mouth and the raised section with the stop, retain the upper portion on the cover when the tamper-evident strap is severed.

10. A tamper-evident bottle comprising:

a bottle portion for containing a liquid drink; and a tamper evident cap attached to the bottle portion and comprising:

a collar having an attachment feature residing in a horizontal plane for attaching the cap to a bottle;

a mouthpiece connected to the collar for drinking liquid from the bottle;

a cover hingedly attached to the collar and having a closed position wherein the mouthpiece is covered and an open position wherein the mouthpiece is uncovered to allow drinking; and a tamper-evident strap having:

a lower portion hingedly attached to the collar, and an upper portion non-disengageably engagable with the cover when the cover is placed in the closed position and remaining non-disengageably engaged with the cover thereafter when the cover is placed in the open position, wherein the tamper-evident strap is severable to separate the upper portion from the lower portion when the cover is opened, and wherein the lower portion is biased towards the horizontal plane when detached from the upper portion and moves outward from the cap providing a visual indication that the cap has been opened, where:

the upper portion of the tamper-evident strap includes a lateral slot; and the cover includes an engagement mouth, the upper portion of the tamper-evident strap passing therethrough, the engagement mouth having a lip for engagement with the lateral slot.

11. The tamper evident bottle of claim 10, wherein the bottle portion includes male threads and the tamper evident cap include female threads for engaging the male threads to attach the tamper evident cap to the bottle portion.

12. The tamper-evident bottle cap of claim 10, wherein:

the upper portion and the lower portion tamper-evident strap are connected by a severable strip prior to severing the upper portion from the lower portion;

before severing the severable strip, the lower portion of the tamper-evident strap resides against a wall, and the upper portion of the tamper-evident strap resides against an upper wall above the wall; and the severable strip of the tamper-evident strap resides between the wall and the upper wall on the closed cap.

13. The tamper-evident bottle cap of claim 10, wherein:

the cover further includes a raised section above the engagement mouth;

an upper end of the upper portion of the tamper-evident includes a stop which reaches past and over the raised section of the cover when the tamper-evident strap fully engages the cover to resist separation of the upper end of the upper portion of the tamper-evident strap from the cover, and the combined cooperation of the lateral slot with the engagement mouth and the raised section with the stop, retain the upper portion on the cover when the tamper-evident strap is severed.

* * * * *